United States Patent [19]

Jagannathan et al.

[11] Patent Number: 5,059,243

[45] Date of Patent: Oct. 22, 1991

[54] TETRA AZA LIGAND SYSTEMS AS COMPLEXING AGENTS FOR ELECTROLESS DEPOSITION OF COPPER

[75] Inventors: Rangarajan Jagannathan, Hopewell Junction; Randolph F. Knarr, Troy; Mahadevaiyer Krishnan, Hopewell Junction; Gregory P. Wandy, Peekskill, all of N.Y.

[73] Assignee: International Business Machines Corporation, Armonk, N.Y.

[21] Appl. No.: 344,878

[22] Filed: Apr. 28, 1989

[51] Int. Cl.[5] ..... C23C 22/00; C23C 18/00

[52] U.S. Cl. ..... 106/1.26; 106/1.23; 427/98; 427/304; 427/437

[58] Field of Search ..... 106/1.26, 1.23; 427/98, 427/304, 437

[56] References Cited

U.S. PATENT DOCUMENTS

| | | | |
|---|---|---|---|
| 2,872,346 | 2/1959 | Miller | 117/65 |
| 3,318,711 | 5/1967 | Foulke | 106/1 |
| 3,870,526 | 3/1975 | Pearlstein et al. | 106/1 |
| 4,143,186 | 3/1979 | Davis | 427/345 |
| 4,301,196 | 11/1981 | McCormack et al. | 427/305 |
| 4,643,793 | 2/1987 | Nakaso et al. | 156/306.6 |
| 4,818,286 | 4/1989 | Jagannathan et al. | 106/1.23 |

FOREIGN PATENT DOCUMENTS

| | | |
|---|---|---|
| 57-009865 | 1/1982 | Japan . |
| 57-009866 | 1/1982 | Japan . |
| 57-009867 | 1/1982 | Japan . |
| 59-059872 | 4/1984 | Japan . |
| 59-123760 | 7/1984 | Japan . |
| 59-211564 | 11/1984 | Japan . |
| 59-219458 | 12/1984 | Japan . |
| 1109470 | 8/1984 | U.S.S.R. . |

OTHER PUBLICATIONS

Pearlstein et al., "Electroless Copper Plating Using Dimethylamine Borane", Plating, vol. 60, No. 5, 1973, pp. 474–476.

"Electroless Copper Plating" in Modern Electroplating (book), Ed. F. A. Lowenheim, John Wiley, 1974, pp. 734–739.

*Primary Examiner*—William R. Dixon, Jr.
*Assistant Examiner*—Melissa Bonner
*Attorney, Agent, or Firm*—Philip J. Feig

[57] ABSTRACT

An electroless copper plating bath uses a series of tetradentate nitrogen ligands. The components of the bath may be substituted without extensive re-optimization of the bath. The Cu-tetra-aza ligand baths operates over a pH range between 7 and 12. Stable bath formulations employing various buffers, reducing agents and ligands have been developed. The process can be used for metal deposition at lower pH and provides the capability to use additive processing for metallization in the presence of polyimide, positive photoresist and other alkali sensitive substrates.

41 Claims, 3 Drawing Sheets

Triethylenetetraamine 1,5,8,12 Tetraazadodecane 1,4,8,12 Tetraazacyclopentadecane 1,4,8,11 Tetraazaundecane 1,4,8,11 Tetraazacyclotetradecane Triethylenetetraamine 1,5,8,12 Tetraazadodecane 1,4,8,12 Tetraazacyclopentadecane 1,4,8,11 Tetraazaundecane 1,4,8,11 Tetraazacyclotetradecane

TETRA AZA LIGAND SYSTEMS AS COMPLEXING AGENTS FOR ELECTROLESS DEPOSITION OF COPPER

BACKGROUND OF THE INVENTION

This invention relates to electroless copper plating baths and more specifically relates to electroless copper bath using neutral ligands based on nitrogen to metal bonds.

Electroless copper plating is widely practiced in the electronics industry, particularly for plating through holes of printed circuit boards by the superior additive process. The current practice of electroless copper plating involves the use of formaldehyde as a reducing agent. Formaldehyde generally requires the operation of the plating bath at a highly alkaline pH, greater than approximately 11. The high pH requirement limits the application of additive copper plating in the presence of alkali sensitive substrates such as polyimide and positive photoresists and possibly ceramic substrates such as aluminum nitride.

In U.S. Pat. No. 4,818,286, entitled "Electroless Copper Plating Bath", and assigned to the same assignee as that of the present application, there is described a plating bath arrangement obviating the requirement of formaldehyde and operating at lower pH.

In the present invention a novel systems approach is applied to electroless plating. Using the approach, the same metal-ligand system is used in a wide variety of buffer systems to formulate stable bath compositions providing acceptable plating performance under varying operating conditions. Such versatility is not possible using existing electroless processes including copper-formaldehyde as described in the article entitled "Electroless Copper Plating Using Dimethylamine Borane" by F. Pearlstein and R. F. Weightman, Plating, May 1973, pages 474–476.

SUMMARY OF THE INVENTION

In the present invention an electroless copper plating bath comprises a complexing system based upon copper-tetra-aza ligand chemistry, a buffer system, a reducing agent and additives for long term stability and desirable metallurgy. For copper deposition a quantity of tetra-aza ligands such as triethylenetetraamine, 1,5,8,12 tetraazadodecane, 1,4,8,11 tetraazaundecane, 1,4,8,12 tetraazacyclopentadecane and 1,4,8,11 tetrazacyclotetradecane, amine boranes additives and buffers resulting in a bath having a pH in the range of approximately 7 to 12 can be successfully used.

The advantage of the systems approach is that any one of the components of the plating bath can be changed without significantly adversely affecting the bath performance and hence without requiring excessive re-optimization of the bath. Therefore, the changes of the operating condition of the plating bath can be made dependent solely upon the substrate requirements.

The present invention concerns a novel electroless copper plating system based on a series of tetradentate nitrogen ligands. System components are able to be substituted without extensive system re-optimization. By means of a suitable choice of the system components, bath compositions for a given application be easily formulated. The concept has been demonstrated for Cu-tetra-aza ligand systems over a wide pH range of 7 to 12. Stable bath formulations employing various buffers, reducing agents and ligands have been developed. Plating rates of 1 to 4 microns per hour have been achieved using the various compositions in the aforementioned pH range. Operation at temperatures in the range from approximately 45° C. to 70° C. has also been achieved. Resistivity measurements in the range between 1.9 to 2.4 microohm cm have been measured, which values are comparable to those obtained with the conventional formaldehyde process. The versatility of the process provides the flexibility in application over a wide range of operating conditions, e.g. pH and temperature. The bath can be used for metal deposition at lower pH and for providing an opportunity to use additive processing for metallization in the presence of polyimide, positive photoresists and other alkali sensitive materials.

A principal object of the present invention is therefore, the provision of an electroless plating bath based on a series of tetradentate nitrogen ligands.

Another object of the invention is the provision of an electroless plating bath the components of which are capable of being substituted without extensive re-optimization of the bath.

A further object of the invention is the provision of a Cu-tetra-aza ligand electroless plating bath which is usable over a wide range of pH, especially at a low pH in the range between 7 and 12.

Further and still other objects of the invention will become more clearly apparent when the following description is read in conjunction with the accompanying drawings.

DETAILED DESCRIPTION

An electroless metal deposition process is essentially an electron transfer process mediated by a catalytic surface. The heterogeneous catalytic process involves the acceptance of electrons from a reducing agent by the catalytic surface. The electrons can be used to reduce the metal ions in solution, resulting in metal deposition on the surface. The electroless plating bath formulation is optimized to enhance the heterogeneous electron transfer process while minimizing the homogeneous reaction between a reducing agent and a metal ion in solution. Such a situation is critical for the successful continuous operation of the electroless bath. Meeting the criteria enables patterned metal deposition on catalytically activated areas of a substrate and building fine line circuitry needed in modern high level computer packages.

The successful operation of an electroless copper bath therefore, depends upon the reducing agent and the complexing agent for copper ions in solution. There are three reducing agents in wide use for electroless metal deposition. The reducing agents are formaldehyde, hypophosphite and the amine-boranes. Formaldehyde is an effective reagent only at pH above 11 and is generally ineffective for electroless plating at lower pH. Hypophosphite has been extensively used for electroless Ni-P and Co-P plating at a wide range of pH. However, hypophosphite is a poor reducing agent for electroless copper plating. Systems using hypophosphite generally are limited to deposition of up to one micron of copper. The preferred reducing agent appears to be amine boranes. Dimethylamine borane (DMAB) is the preferred reducing agent because of its high solubility in water and ready availability. Other amine boranes, such as morpholine, T-butyl, isopropyl or the like are equally useful in practicing the present invention.

The copper ion is introduced by a copper salt such as copper sulfate, acetate, nitrate, fluoroborate and the like.

Figure 1A:
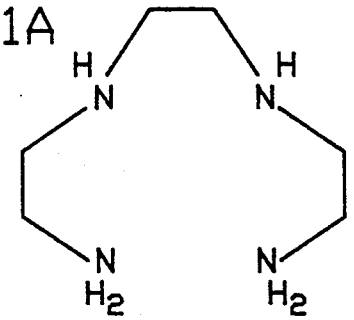
FIGS. 1A through 1E are chemical structural diagrams of preferred tetra-aza ligands used in practicing the present invention.
Figure 1B:
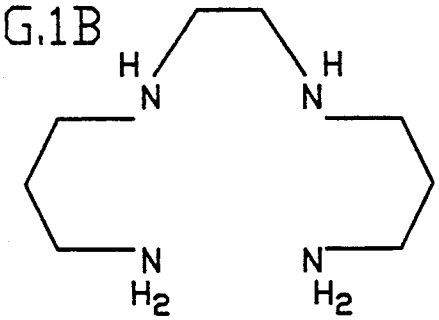
Figure 1C:
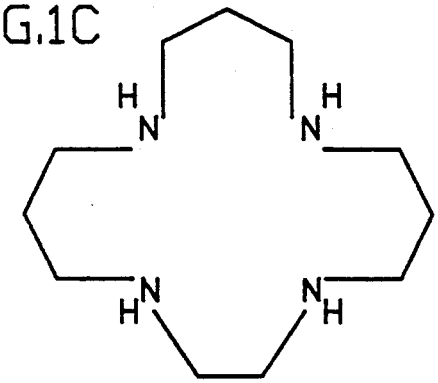
Figure 1D:
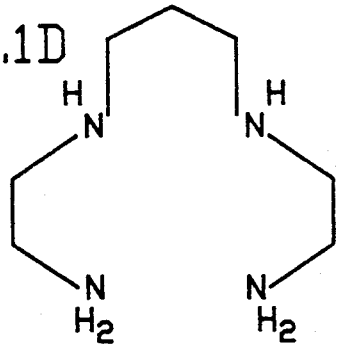
Figure 1E:
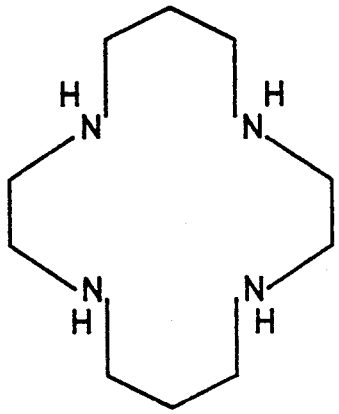

The choice of a suitable complexing agents for copper ions in solution is critical for the stable and successful operation of the electroless plating bath. Stable complex formulation reduces the possibility of homogeneous copper deposition and increases the overall stability of the electroless bath which is essential for long term operation of the bath. The ligand used in this invention form tetra-dentate complexes with copper which have high stability constants with logK values greater than 20. Preferred examples of tetra-aza ligands are illustrated in FIGS. 1A through 1E. FIG. 1A shows the chemical structural diagram for triethylenetetraamine. FIG. 1B shows the chemical structural diagrams for 1,5,8,12 tetraazadodecane. FIG. 1C shows the chemical structural diagram for 1,4,8,12 tetraazacyclopentadecane. FIG. 1D shows the chemical structural diagram for 1,4,8,11 tetraazaundecane, and FIG. 1E shows the chemical structural diagram for 1,4,8,11 tetraazacyclotetradecane. The preferred ligand is 1,5,8,12 tetraazadodecane which is also known as 1,2 Bis (3-aminopropylamino) ethane or N,N' Bis (aminopropyl) ethylenediamine.

These tetradentate neutral ligands differ from the multidentate anionic ligands such as EDTA, tartrate and citrate which are widely used at present in the practice of electroless plating.

In order to maintain a constant pH value during the deposition process buffers are required. The choice of a buffering system is often dependent upon the reducing agent and the complexing agent used in the plating bath. The nature of the tetra-aza copper complexation is such that a change in the buffering agent is possible without affecting desirable bath characteristics. Buffer systems such as valine (pH 8.7), Tris (hydroxymethyl), aminomethane (pH 9), borax (pH 8 to 10), boric acid (pH 7 to 9) triethanolamine (pH 8 to 11), NaOH (pH 10 to 12) in combination with tetra-aza ligands (open and closed rings) were used to formulate bath compositions over a wide range of pH (7 to 12). All of the compositions provided stable baths at temperatures in the range between 45° C. and 70° C. with similar plating performance. The result is unexpected and provides a novel aspect of the present invention which is not achievable using existing electroless processing including the use of formaldehyde based electroless copper bath. For thin film packaging applications the preferred buffer system is triethanolamine at pH 9, or boric acid at pH 8 to 9.

The preferable reducing agent for copper deposition are amine boranes. The borane component is responsible for electron donation to the catalytic substrate. Other amine adducts such as morpholene borane, t-butylamine borane and pyridine borane are substantially equally useful reducing agents for use in practicing the present invention. However, the preferred reducing agent is dimethylamine borane (DMAB).

Additives are combined in the plating bath to provide various enhancements. Surfactants are added to facilitate hydrogen solution. Surfactants can be anionic, cationic or neutral. In the present invention sodium lauryl sulfate, FC95 BI which is a commercially available surfactant manufactured by the 3M Company, Hexadecyl Trimethylammonium hydroxide are advantageous for the removal of hydrogen bubbles evolved during deposition. The preferred surfactant is Hexadecyl Trimethylammonium hydroxide.

Addition agents such as 1,10 phenanthroline and 2,2 bipyridine are sometimes used to ensure long term stability and to achieve desirable metallurgy such as brightness, ductility, and resistivity. The same result can be achieved with sodium cyanide. Cyanide however is not an essential requirement for the operation of the present invention.

Air agitation or agitation with a mixture of nitrogen and oxygen is especially useful for long term bath operation at temperatures greater than approximately 60° C. and also improve metallurgical qualities of the copper deposit.

A typical electroless plating bath in accordance with the present invention is made of 1,5,8,12 tetraazadodecane—64 mM
Triethanolamine—50 ml/l
Copper sulfate—32 mM
DMAB—68 mM
Sodium lauryl sulfate—10 to 50 mg/l
2,2 Bipyridine—30 to 600 mg/l The pH of the bath was adjusted to 9 using sulfuric acid. However, boric acid is also usable as a pH adjuster. The observed plating rate is between 1 and 4 microns/hour between 45° C. and 60° C.

Plating studies were performed on copper foils 1 to 3 mils thick under various experimental conditions. Electroless deposition was also demonstrated on evaporated/sputtered copper seed layers (thickness of 1 to 2 microns) on Si/Cr substrates and on Pd/Cr substrates and on Pd/Sn seeded non-metallic substrates such as epoxy boards.

Figure 2:
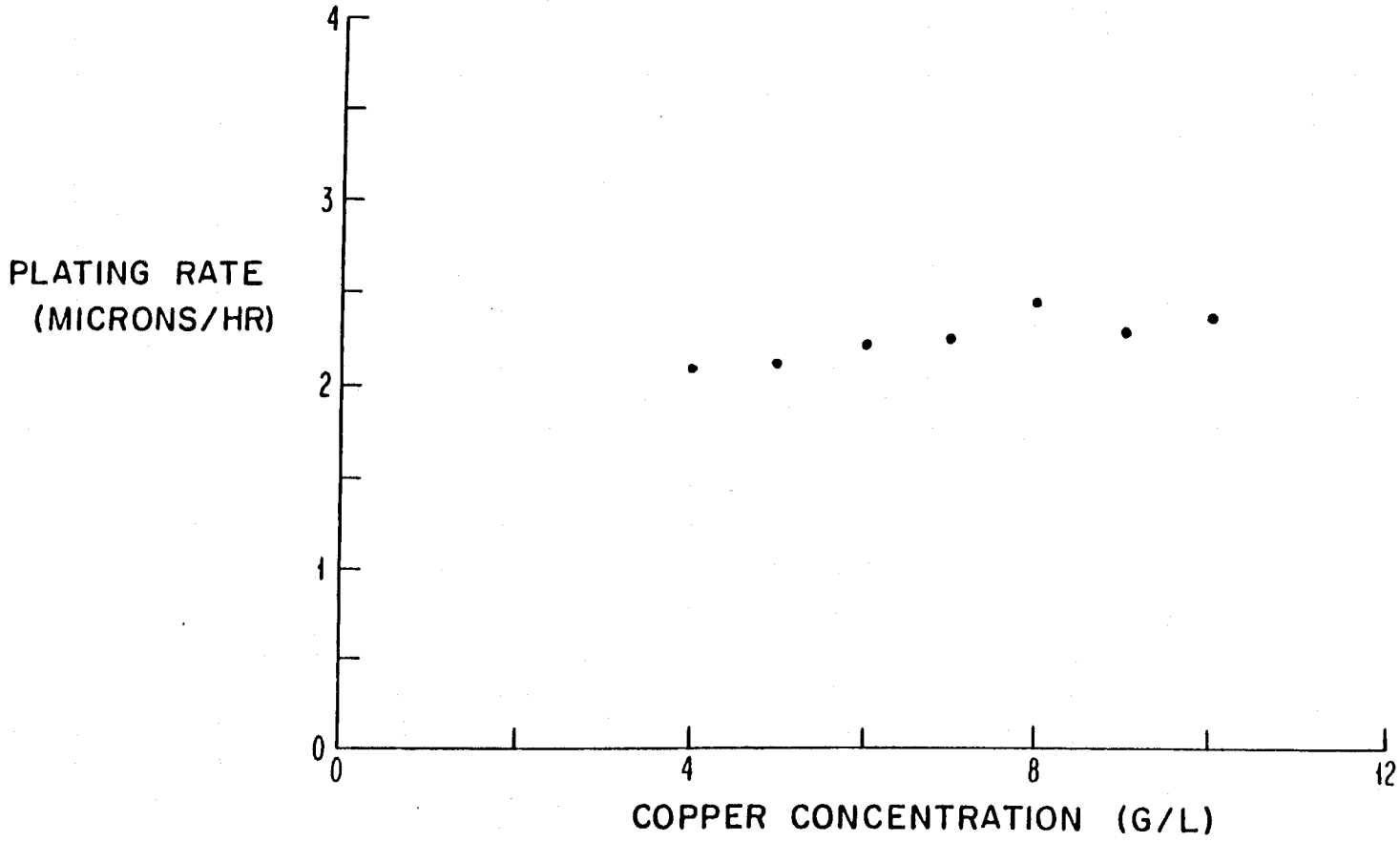
FIG. 2 is a graphical representation of the effect of copper concentration on plating rate.
Figure 3:
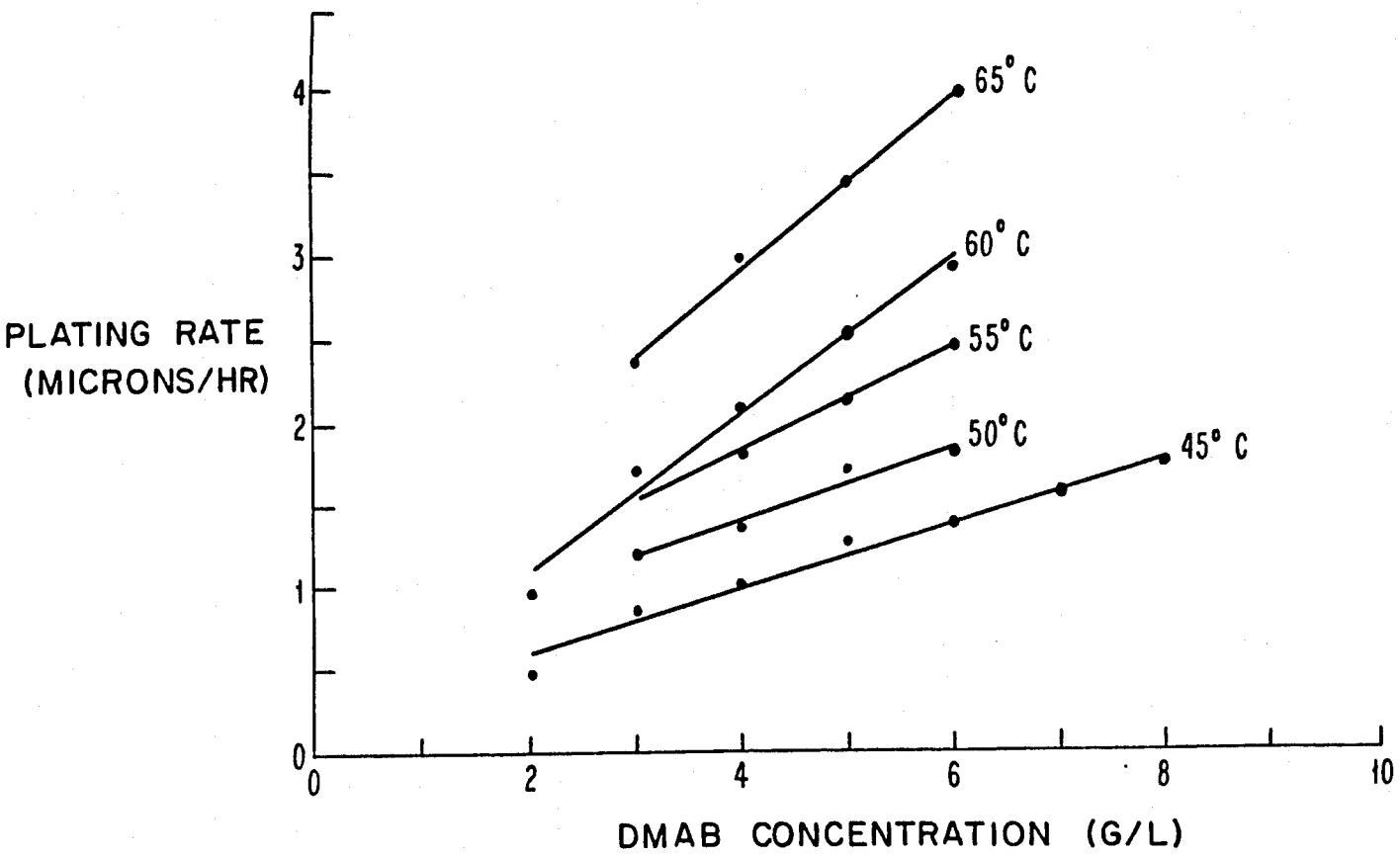
FIG. 3 is a graphic representation of the effect of DMAB concentration on the plating rate at several different temperatures.

FIG. 2 is a graphical representation of the electroless copper plating rate variation with copper ion concentration. The bath contained 11 G/L of 1,5,8,12 - tetraazadodecane, 50 mL/L triethanolamine, 4 G/L of DMAB and 110 micrograms/L of phenanthroline with the pH adjusted to 9. As can be seen, the plating rate is substantially independent of the copper concentration between about 8 and 40 mM. The typical plating rate variations as a function of DMAB concentration at different temperatures is graphically shown in FIG. 3. The bath contained 11 G/L 1,5,8,12 tetraazadodecane, 50 mL/L triethanolamine, 8 G/L copper sulfate and 110 micrograms/L phenanthroline with the pH adjusted to 9.0. The plating rate increases linearly as a function of DMAB concentration and temperature.

The electroless plated copper appears bright and resistivity measurements of films of 3 to 6 microns thickness indicate values in the range between 1.9 and 2.4 microohm cm.

The effect of changing the tetra-aza ligands on the stability of electroless plating was studied. The ligands triethylenetetraamine and 1,5,9,13 tetraazatidecane are not effective replacements for 1,5,8,12 tetraazadodecane. Using the two former ligands, the bath homogeneously decomposes in the presence of the complexing agents. The ligand 1,4,8,11 tetraazaundecane (also known as N,N' Bis (2-aminoethyl) 1,3 propanediamine)

complexes copper strongly enough to result in stable bath operation. Extending the concept, we have found that the macrocyclic ligands 1,4,8,11 tetraazacyclotetradecane and 1,4,8,12 tetraazacyclopentadecane are about equally effective in stabilizing a usable electroless copper plating bath.

The above observations are rationalized on the basis of the known stability order of copper complexation. The stability increases in the order triethylenetetramine, tetraazatridecane, tetraazadodecane, tetraazaundecane, tetraazacyclopentadecane, tetraazacyclotetradecane. The described electroless plating bath is successfully operable with ligands that bind copper with a stability equal to or greater than 1,5,8,12 tetraazadodecane.

While in the above described preferred embodiment a pH for the operation of the triethanolamine buffer bath is 9, the bath has been successfully operated with a pH as low as 7.8. Using the macrocyclic ligands 1,4,8,11 tetraazacyclotetradecane and 1,4,8,12 tetraazacyclopentadecane with the triethanolamine buffer, electroless plating was performed at a pH as low as 7 due to the additional stability conferred by the macrocycle.

While there has been described and illustrated a preferred electroless copper bath and several modifications and variations thereof, it will be apparent to those skilled in the art that further and still other modifications and variations are possible without deviating from the broad principle of the invention which shall be limited solely by the scope of the appended claims.

What is claimed is:

1. An electroless copper plating bath comprising:

4 to 15 grams per liter of a copper salt 40 to 200 mM of a tetra-aza ligand 3 to 10G/l of an amine borane 25 to 100 ml/l of a buffer, wherein said copper salt is selected from the group consisting of copper sulfate, a cetate, nitrate, and fluoroborate, said tetra-aza ligand is selected from the group consisting of 1,5,8,12 tetraazadodecane, 1,4,8,11 tetraazaundecane, 1,4,8,11 tetraazacyclotetradecane and 1,4,8,12 tetraazacyclopentadecane, said amine borane is selected from the group consisting of DMAB, morpholine borane, t-butylamineborane and pyridineborane, said buffer is selected from the group consisting of valine, Tris (hydroxymethyl), aminomethane, borax, triethanolamine, NaOH, triisopropanolamine and ethanolamine wherein the pH of the bath is in the range substantially between 7 and 12.

2. An electroless copper plating bath as set forth in claim 1, further comprising a surfactant.

3. An electroless copper plating bath as set forth in claim 2, wherein said surfactant is selected from the group consisting of sodium lauryl sulfate, FC95 surfactant and hexadecyl trimethyl ammonium hydroxide.

4. An electroless copper plating bath as set forth in claim 1 further comprising an addition agent.

5. An electroless copper plating bath as set forth in claim 4 wherein said addition agent is selected from the group consisting of 1,10 phenanthroline, 2,2 bipyridine and sodium cyanide.

6. An electroless copper plating bath as set forth in claim 2, further comprising an addition agent.

7. An electroless copper plating bath as set forth in claim 6 wherein said addition agent is selected from the group consisting of 1,10 phenanthroline, 2,2 bipyridine and sodium cyanide.

8. An electroless copper plating bath as set forth in claim 1 or 2 or 4 or 6 wherein the pH is in the range substantially between 7 and 9.

9. An electroless copper plating bath as set forth in claim 1 or 2 or 4 or 6 wherein the bath stable over at a temperature in the range between 45° C. and 70° C.

10. An electroless copper plating bath as set forth in claim 1 or 2 or 4 or 6 for providing copper deposits on a substrate.

11. An electroless copper plating bath as set forth in claim 10 wherein said substrate is an alkali sensitive substrate.

12. An electroless copper plating bath as set forth in claim 11 wherein said alkali sensitive substrate is polyimide.

13. An electroless copper plating bath as set forth in claim 11 wherein said alkali substrate includes positive photoresist.

14. An electroless copper plating bath as set forth in claim 10 wherein said substrate contains a copper seed layer on a Si/Cr substrate.

15. A electroless copper plating bath as set forth in claim 10 wherein said substrate is Pd/Sn seeded nonmetallic substrate.

16. An electroless copper plating bath as set forth in claim 1, wherein the plating bath is agitated by bubbling air.

17. An electroless copper plating bath as set forth in claim 1, wherein the plating bath is agitated by bubbling a mixture of nitrogen and oxygen.

18. An electroless copper plating bath consisting of 64 mM—tetra-aza ligand 32 mM—Copper sulfate 68 mM—DMAB 10 to 50 mg/l—hexadecyl Trimethyl ammonium hydroxide 30 to 600 mg/l—2,2 Bipyridine and a sufficient quantity of buffering agent selected from the group consisting of valine, Tris (hydroxymethyl), aminomethane, borax, NaOH, triethanolamine, triisopropanolamine and ethanolamine and wherein said tetra-aza ligand is selected from the group consisting of 1,5,8,12 tetraazadodecane, 1,4,8,11 tetraazaundecane, 1,4,8,11 tetraazacyclotetradecane and 1,4,8,12 tetraazacyclopentadecane and a sufficient amount, of acid to adjust the pH to be in the range substantially between 7 and 12.

19. An electroless copper plating bath as set forth in claim 18, wherein the pH is adjusted to be in the range substantially between 7.0 to 9.0.

20. An electroless copper plating bath as set forth in claim 18, wherein said sufficient quantity of buffering agent is 50 ml/l triethanolamine.

21. An electroless copper plating bath as set forth in claim 18, wherein said sufficient quantity of buffering agent is 0.1 molar borax.

22. An electroless copper plating bath as set forth in claim 18, wherein said sufficient quantity of buffering agent is 15 g/l boric acid.

23. An electroless copper plating bath as set forth in claims 20, 21, or 22 wherein said tetra-aza ligand is 1, 5, 8, 12 tetraazadodecane.

24. An electroless copper plating bath as set forth in claims 20, 21 or 22 wherein said tetra-aza ligand is 1, 4, 8, 11 tetraazaundecane.

25. An electroless copper plating bath as set forth in claims 20, 21 or 22 wherein said tetra-aza ligand is 1, 4, 8, 11 tetraazacyclotetradecane.

26. An electroless copper plating bath as set forth in claims 20, 21 or 22 wherein said tetra-aza ligand is 1, 4, 8, 12 tetraazacyclopentadecane.

27. An electroless copper plating bath as set forth in claim 18, wherein the plating bath is agitated by bubbling air.

28. An electroless copper plating bath as set forth in claim 18, wherein the plating bath is agitated by bubbling a mixture of nitrogen and oxygen.

29. An electroless copper plating bath comprising:

a copper salt;

a complexing system comprising a tetra-aza ligand which forms tetra-dentate complexes with copper having high stability constants;

a buffer system which when changed does not substantially affect the bath characteristics, and a reducing system comprising an amine borane.

30. A bath as set forth in claim 29, further comprising a surfactant.

31. A bath as set forth in claim 29, further comprising an addition agent.

32. A bath as set forth in claim 29, wherein said copper salt is selected from the group consisting of copper sulfate, copper acetate, copper nitrate, and copper fluoroborate.

33. A bath as set forth in claim 29, wherein said complexing agent is selected from the group consisting of 1,5,8,12 tetraazadodecane, 1,4,8,11 tetraazaundecane, 1,4,8,11 tetraazacyclotetradecane, and 1,4,8,12 tetraazacyclopentadecane.

34. A bath as set forth in claim 29, wherein said buffer system is selected from the group consisting of valine, Tris(hydroxymethyl), aminomethane, borax, triethanolamine, NaOH, triisopropanolamine and ethanolamine.

35. A bath as set forth in claim 29, wherein said reducing system is selected from the group consisting of DMAB, morpholine borane, t-butylamineborane and pyridineborane.

36. A bath as set forth in claim 29, wherein said copper salt is selected from the group consisting of copper sulfate, copper acetate, copper nitrate, and copper fluoroborate, said complexing system is selected from the group consisting of 1,5,8,12 tetraazadodecane, 1,4,8,11 tetraazaundecane, 1,4,8,11 tetraazacyclotetradecane and 1,4,8,12 tetraazacyclopentadecane, said buffer system is selected from the group consisting of valine, Tris (hydroxymethyl), aminomethane, borax, triethanolamine, NaOH, triisopropanolamine and ethanolamine, and said reducing system is selected from the group consisting of DMAB, morpholine borane, t-butylamineborane and pyridineborane.

37. A bath as set forth in claim 29, wherein the pH is in the range substantially between 7 and 12.

38. A bath as set forth in claim 37, wherein the pH is in the range substantially between 7 and 9.

39. A bath as set forth in claim 29, wherein said buffer system provides a stable bath over a temperature range between approximately 45 degrees C. and 70 degrees C.

40. A bath as set forth in claim 30, wherein said surfactant is selected from the group consisting of sodium lauryl sulfate, FC 95 surfactant, and hexadecyl trimethylammonium hydroxide.

41. A bath as set forth in claim 31, wherein said addition agent is selected from the group consisting of 1,10 phenanthroline, 2,2 bipyridine, and sodium cyanide.

* * * * *